US005082169A

United States Patent [19]

Aurness et al.

[11] Patent Number: 5,082,169

[45] Date of Patent: Jan. 21, 1992

[54] TWO-DOOR, LOCKED MAILBOX

[76] Inventors: Harold O. Aurness, 5808 Knox Ave. North, Brookyln Center, Minn. 55430; Thomas G. Mahler, 3841 Unity Ave. North, Robbinsdale, Minn. 55422

[21] Appl. No.: 487,833

[22] Filed: Mar. 5, 1990

[51] Int. Cl.[5] ..... B65D 91/00

[52] U.S. Cl. ..... 232/17; 232/20; 232/34

[58] Field of Search ..... 232/20, 21, 17, 19, 232/27, 28, 29, 34, 35, 37; 292/39, 50

[56] References Cited

U.S. PATENT DOCUMENTS

| | | | |
|---|---|---|---|
| 460,106 | 9/1891 | Bilhimer | 232/21 |
| 879,402 | 2/1908 | Myrhow | 232/20 X |
| 1,038,583 | 9/1912 | Hodgkinson | 232/20 |
| 1,256,080 | 2/1918 | Travis | 232/20 |
| 3,396,999 | 8/1968 | Knapp | 292/39 |
| 3,801,002 | 4/1974 | Best | 232/17 |
| 3,802,619 | 4/1974 | Vanderveer | 232/17 |
| 4,757,942 | 7/1988 | Young, Jr. | 232/17 |
| 4,815,656 | 3/1989 | Smith et al. | 232/17 X |
| 4,869,425 | 9/1989 | Chiou | 232/17 |

*Primary Examiner*—Blair M. Johnson

[57] ABSTRACT

A mail box according to the teachings of the present invention is shown as including a rectangular box with a receiver's door side-hinged and locked by a combination lock, to and within the frame of a bottom-hinged delivery door. The bottom-hinged delivery door is locked at the top and side and opened only by a delivery person with a special release tool which is thrust into a side chamber of the unit and forces a latch gate sideways which draws a latch from the side of the door and simultaneously transmits the force of the entrance, through tangential movement of a release rod, to an L-shaped connector to a release cable which extends through rollers to the top latch of the delivery door. Spring action automatically closes both latches. Supplemental brace hinges are included to enable the delivery door to be held ridgidly horizontal when open. Automatic means to indicate a package has been delivered is provided by a signal finger out the front of the side chamber which is activated by connecting means to the release rod and is released by hand. Other hand operated signal means are provided to indicate, by an arm extending out the front or one extending out the top that there is a package or letter in the box. A letter signal wheel in the receiver's door, activated automatically by the letter slot, indicates a letter delivery by showing a certain color.

7 Claims, 1 Drawing Sheet

TWO-DOOR, LOCKED MAILBOX

SUMMARY OF THE INVENTION

The present invention solves the need for secured package and letter delivery means by providing a mail box with special locks and access means. Specifically, two doors are provided, one within the other, in which the outer, delivery door is hinged at the bottom to the frame of the mail box and latched at the top by a cable extension from a release rod at the side of the box in a sealed chamber. The release rod is activated by being pushed tandemly by a release tool entering the chamber by hand which simultaneously releases a side latch of the delivery. Specifically, the release tool meets a plug member which forces a pivoting arm of the tool sideways which forces a latch gate sideways pulling the side latch with it. The door is aided to open by a spring biased push button at the top. Spring means automatically relocks the door when closed.

The release rod is also automatically returned by spring means within a bracket through which it extends and in which it is attached to a drop arm from a disk supported by the bracket. The disk, rotated by its extension to the release rod, extends a signal finger out the front of the side chamber to indicate, automatically that a package delivery was made. The signal finger is released to retract by hand.

A supplemental, double signal, hand operated, is also located in the side chamber and provided to indicate a package pickup or a delivery was made. It comprises a signal disk with an arm attached on the perimeter leading out the front of the unit with means to limit it to a long or short extension. Another arm extends out the top of the unit attached, by a connecting arm to the perimeter of the signal disk, with spring means to help the extension. This signal arm is discardable if the units are stacked. The disk has its rotation limited by means along its circumference.

The receiver's door is side-hinged to, and within the delivery door and opened by a patented combination lock which features push-button combination changing means.

A fourth signal in the form of a wheel extending half its diameter out the front of the receiver's door is activated by a weighted closure in a letter slot. The closure lifts a floating housing which contacts an extension from the perimeter of the signal wheel. The wheel is rotated automatically when a letter is delivered and shows a different color on the outside. The signal color is relocated by hand.

DESCRIPTION

Figure 1:
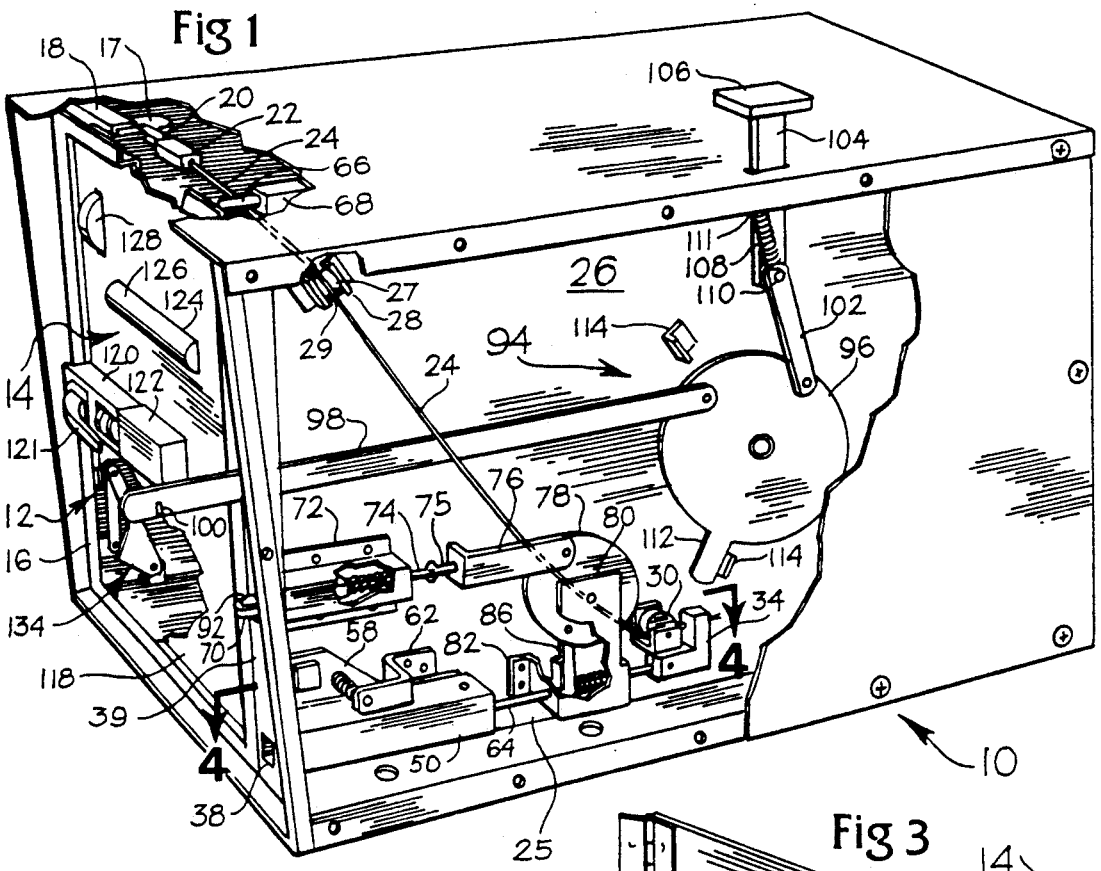
FIG. 1 shows a perspective view of a mail box with cutaway views.
Figure 2:
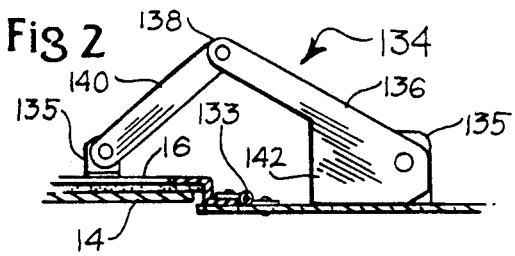
FIG. 2 shows a diagramatic view of a brace hinge.
Figure 3:
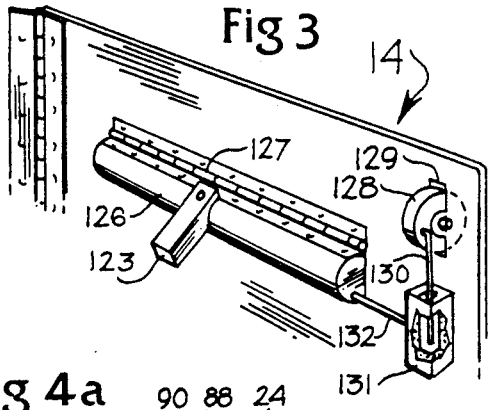
FIG. 3 shows a perspective view of the letter slot closure and the signal wheel and floating housing on the inside of the receiver's door.
Figure 4A:
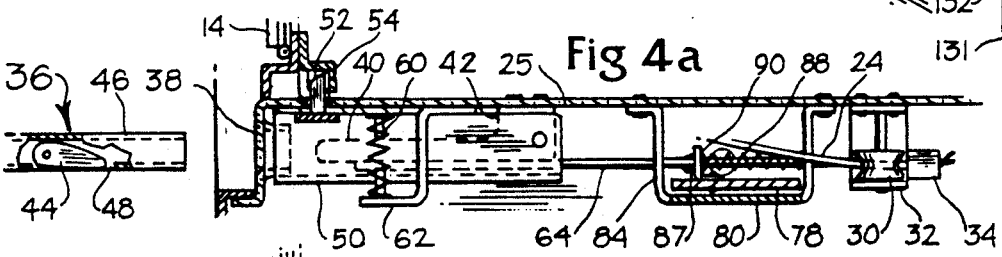
FIG. 4*a* shows a top cross-sectional view of the latch gate, release rod, signal finger connection and cable connection in closed position according to section line 4—4 of FIG. 1.
Figure 4B:
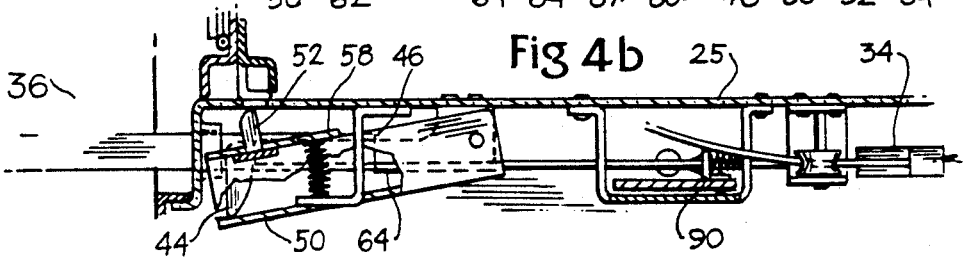
FIG. 4*b* shows a top cross-sectional view of the latch gate, release rod, signal finger connection and cable connection in open position according to section line 4—4 of FIG. 1.

A mailbox to hold letters and packages featuring two lockable access doors is wholly shown in the drawings and generally designated 10. Unit 10 is a generally rectangular shape with the doors at a narrow front side. A bottom hinged delivery door 12 which includes a side hinged receiver's door 14 within its perimeter comprises mainly a frame 16 with door latches 18 and 20 at a top and side. A latch bolt 22, spring-biased in a latch housing 24 extends a latch cable 26 diagonally from the top latch 18 down through rollers 28 and 30 to an elbow connection 32 in a side chamber 34 of the unit joining it to a cable release rod 36 extending horizontally toward the front through a holding bracket 38 and spring 40, biasing it forward.

The fore end of the cable release rod 36 rests in parallel spaced relation alongside a release plug 42 having a square cross section. The release plug 42 is attached to the inside wall of the side chamber 34 and extends a free end forward. It is covered in parallel spaced relation by a latch gate 44 mounted to pivot from a rearward end. The latch gate 44 comprises a horizontal panel 46 attached to two vertical panels in a step configuration. An upper vertical panel 48 comprises, in addition, the side latch bolt 50 and a spiral spring 52 which extends horizontally over the latch gate 44 to attach to a bracket 58 from, and parallel with, the side chamber wall.

Both latches of the delivery door 12 are released simultaneously by inserting a special release tool 56 into an access opening 58 in the front of the side chamber 34 onto the release plug 42. The release tool 56 comprises a square tube 60 having an open end opposite a handled end with a pivotal wedge-shaped bar 62 in the tube 60 opposite an opening 64 allowing the bar 62 to exit. The release plug 42 forces the pivotal bar 62 to swing laterally out the opening 64 to contact and force the latch gate 44 away from the side latch 20. At the same time it contacts and pushes the cable release rod 36 to open the top latch 18 of the delivery door. A spring-biased pusher bar 66 on the ceiling of the unit forces the door 12 to swing down.

Another function of the cable release rod 36 is to activate a finger signal 68 to extend from the front of the unit to signal a delivery. The signal finger 68 is spring-biased inside a housing 70 in the side chamber 34 with a connecting rod member 72 reaching back to form a sliding joint 74 with a first pivotal arm 76 from a vertical rotatable disk 78 axially secured in the side chamber 34. The disk 78 further provides a second pivotal arm 80 extending from the perimeter down to the cable release rod 56 where it is slideable attached between the spring 40 and a pinched part 82 of the rod 36 forward of it. The finger signal 68 remains extended when the second arm 80 is pushed by the pinched part 82 and returned due to the sliding joint 74 and a snap spring catch 84 on the top of the outer end of the finger signal 68.

A pickup signal assembly 86 to let a mail person know a letter or package is in the unit to be picked up, is also a feature in the side chamber 34. It comprises a large rotatable signal disk 88 attached at its center to the inner wall of the side chamber 34. A long horizontal signal arm 90, attached rotatably near the top of the signal disk 88, extends forward out an opening in the front of the side chamber 34. The signal arm 90, hand operated, stays put at one of two notches 92 spaced apart on the bottom edge of the signal arm 90 which catch on the edge of the opening. A long arm extension indicates a letter or parcel is in unit 10 to be picked up by a mail person. Two stop brackets 94 on the inner wall of the side chamber 34 are spaced to catch a short stop arm 46 from the signal disk 88 to limit its rotation to keep the signal arm 90 from disappearing into the side chamber 34.

The signal disk assembly 86 also includes a second alternative signal 98. It comprises a short arm 100 attached rotatably at one end to the perimeter area of the signal disk 88 with a signal bar 102 attached rotatably on the opposite end extending vertically up through the ceiling of the side chamber 34. A spiral spring 104 attached at the latter joint extending up to an attachment point on the ceiling of the side chamber 34 helps the signal bar 102 to its extended position.

The second mailbox door 14, a receiver's door, side-hinged to the frame 16 of delivery door 12, comprises a rectangular plate 106 flush at its perimeter to the outside of the frame 16 and a combination lock 108 with a pull handle 110. The door 14 further comprises a horizontal letter slot 112 with a cylindrical closure bar 114 extending a smaller part of its circumference outside the letter slot 112 to wholly fill the letter slot 112. The closure bar 114 is secured on the inside above the letter slot 112 by a hinge 116. A bar weight 118 is fastened to the center of the closure bar 114 to insure closing.

A signal wheel 120, incorporated with the letter slot 112, extends half its diameter out the front of the receiver's door 14 in a vertical slot 122 by showing another color on half its surface indicating there is a letter inside. A pin 124 connected rotatably off center to the inside of the signal wheel 120 extends an end, unconnected, into the open end of a floating box 126 below the signal wheel 120. The box 126 is connected laterally by a rod 128 to the end of the cylindrical closure bar 114.

A letter through the letter slot 112 activates the floating box 126 to move upward pushing the pin 124 to move the signal wheel 120. When the box 126 returns to its original position the signal wheel 120 remains unmoved until rotated by hand to the other color position.

Supplementing the hinge of the delivery door 12 are two brace hinges 130, one on each side at the bottom of the delivery door 12. Each brace hinge 130 is secured rotatably at each end to brackets 132 on the floor of unit 10 and the door frame 16 side members. In the open position, a brace arm 134 extends up at an angle from the bracket 132 in unit 10 to an apex point 136 where it is rotatably secured to an arm 138. Arm 138 descends at an angle to bracket 132 on the delivery door frame 16 side members. Brace arm 134 is formed to include a foot area 140 on its lower end which rests on the floor of unit 10 as a brace to help support the weight of the delivery door 12 in an open, horizontal position.

We claim:

1. A two-door mailbox unit comprising a box of generally rectangular shape having a bottom hinged delivery door at a front end, a second, receiver's door, side-hinged to and within a perimeter of the delivery door and lockable thereto; a mail slot in the second door featuring a delivery indicator; automatic locking means for the delivery door provided by spring-biased latch bolts at a side and top; a release plug in a side chamber of the box; a pivotal spring-biased latchgate covering the release plug in parallel spaced relation and containing the side latch bolt; a spring-biased cable release rod also in parallel relation to the release plug connected by an elbow to a latch cable leading through rollers to the top latch bolt of the unit; wherein the top and side latch bolts are simultaneously released by the action of a special release tool entering the side chamber onto the release plug to swing open the latch gate and side latch and contact and push the cable release rod; with the unit further comprising automatic signal means coupled to the cable release rod in the form of a finger-like signal extending out a front of the side chamber activated with unlatching of the delivery door to indicate a delivery; manual signal means to indicate a pick-up is to be made employing a vertically mounted rotatable disk in the side chamber which shows an arm each out the top and side; brace hinges comprising brackets attached to a floor of the box and the delivery door connected by pivotal arms to hold the door horizontally open.

2. The two-door mailbox of claim 1 wherein the release plug projects a forward end clear of the sides of the side chamber and has a square cross section.

3. The two-door mailbox of claim 1 wherein the latch gate is spring-biased and pivotal from a rearward end having a step-shaped profile covering the side and top of the release plug and comprising a lower vertical panel, a horizontal panel, and an upper vertical panel holding said side latch bolt in the side latch.

4. The two-door mailbox of claim 1 wherein the brace hinges comprise, singly, a brace arm disposed at an approximate 45° outward angle from a bracket on the floor of the unit to which it is rotatably attached, with a wedge of the brace arm extending to the floor from about half way up to form a brace; an additional arm rotatably attached to the brace arm at an apex over the bottom hinge of the delivery door in open position extending downward at an approximate 45° angle to be secured rotatably to a bracket on the delivery door; wherein the brace hinges support the delivery door in an open horizontal position and fold up inside the unit in a closed position.

5. The two-door mailbox of claim 1 wherein the automatic signal means to indicate a delivery comprises a finger-like signal extending out the front of the side chamber with a spring catch to hold it extended, a connecting bar from the finger extension through a biasing spring and a sliding joint to a pivotal arm from a rotatable vertical disk mounted in the side chamber, with a second pivotal arm from the disk connecting pivotally to the cable release rod; wherein the action of the cable release rod is transferred to and reversed by the disk to extend the signal, with the sliding joint allowing the cable release rod to return to its neutral position.

6. The two-door mailbox of claim 1 wherein the letter slot comprises a horizontal opening in the receiver's door, a closure bar hinged to an inside top of the opening and extending part of an outward facing profile out of the opening, completely filling it, with the addition of a weight to the closure bar on the inside of the opening to help keep the opening closed by gravity.

7. The two-door mailbox of claim 1 wherein the signal wheel, cooperating with the closure bar of the letter slot to indicate a delivery comprises a rotatable wheel mounted vertically inside the receiver's door extending half its circumference through a slot to the outside with half painted a different color from the other half, a pin extending rotatably from near the perimeter of the wheel on the inside of the door bending to drop vertically to position an end freely in a floating box connected by a horizontal bar to the closure bar; wherein the action of the closure bar lifts the floating box to contact the pin from the signal wheel causing it to rotate and remain in a new position.

* * * * *